US007931477B2

(12) United States Patent
Hirata et al.

(10) Patent No.: US 7,931,477 B2
(45) Date of Patent: Apr. 26, 2011

(54) LOW PROFILE BOARD-TO-BOARD CONNECTOR MATING PAIR WITH SOLDER BARRIER

(75) Inventors: Toshihisa Hirata, Yamato (JP); Tetsuya Asakawa, Veldhoven (NL)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 11/918,763

(22) PCT Filed: Apr. 18, 2006

(86) PCT No.: PCT/US2006/014757

§ 371 (c)(1),
(2), (4) Date: Jan. 21, 2009

(87) PCT Pub. No.: WO2006/130252

PCT Pub. Date: Dec. 7, 2006

(65) Prior Publication Data

US 2009/0305528 A1 Dec. 10, 2009

(30) Foreign Application Priority Data

Apr. 18, 2005 (JP) ..... 2005-119401

(51) Int. Cl.
*H01R 12/00* (2006.01)

(52) U.S. Cl. ..... 439/74

(58) Field of Classification Search ..... 439/74, 439/284, 285, 660, 296, 246, 248, 81, 862
See application file for complete search history.

(56) References Cited

U.S. PATENT DOCUMENTS 5,476,389 A 12/1995 Ono
5,876,217 A 3/1999 Ito et al.
6,793,506 B1 9/2004 Hirata et al.
6,811,411 B1 * 11/2004 Hirata et al. ..... 439/74
6,986,670 B2 * 1/2006 Okura et al. ..... 439/74
7,413,444 B2 * 8/2008 Wang ..... 439/74
7,568,919 B2 * 8/2009 Hoshino et al. ..... 439/74
2007/0275575 A1 * 11/2007 Wang ..... 439/74

FOREIGN PATENT DOCUMENTS

JP 2000-157197 12/2001
JP 200410039258.9 9/2004
WO WO 2005/034296 A1 4/2005

OTHER PUBLICATIONS

International Search Report for PCT/US2004/028443.

* cited by examiner

*Primary Examiner* — Chandrika Prasad
(74) *Attorney, Agent, or Firm* — Timothy M. Morella

(57) ABSTRACT

An electrical connector comprises a generally rectangular dielectric housing with a mating face and a mounting face. A plurality of terminal support posts extend in a direction from the mounting face towards the mating face and each support post has oppositely facing first and second sidewalls and a connecting surface. A plurality of terminal receiving cavities are spaced along a longitudinal axis of the housing for receiving terminals therein. A plurality of terminals are provided with each including a solder tail portion and a generally U-shaped contact portion. The solder tail portion is positioned along the mounting face and the contact portion includes a first, distal contact leg, a second, proximal contact leg spaced from and generally parallel to the first contact leg and a connecting portion extending between the first and second contact legs. The first contact leg extends along the first sidewall, the second contact leg extending along the second sidewall, and the connecting portion extending along the connecting surface.

15 Claims, 5 Drawing Sheets

LOW PROFILE BOARD-TO-BOARD CONNECTOR MATING PAIR WITH SOLDER BARRIER

FIELD OF THE INVENTION

The present invention relates to electrical connectors and, more specifically to low profile board-to-board electrical connectors.

DESCRIPTION OF THE RELATED ART

Conventionally, a board-to-board connector pair is used to electrically connect two parallel circuit boards together (see, for example, Japanese Patent Application Laid-Open (kokai) No. 2004-55463). Such a board-to-board connector pair includes two connectors which are respectively attached to mutually facing surfaces of two circuit boards and projects therefrom. Referring to FIG. 1, first connector 102 includes a plurality of first terminals 103 and is mounted on first circuit board 101. A second, mating connector 112 includes a plurality of second terminals 113 and is mounted on second circuit board 111. The first connector 102 and the second connector 112 are mated with and connected to each other, whereby the first circuit board 101 and the second circuit board 111 are connected together.

Tail portions of the first terminals 103 and tail portions of the second terminals 113 are connected, through soldering, to wiring traces (not shown) formed on the surface of the first circuit board 101 and to wiring traces (not shown) formed on the surface of the second circuit board 101, respectively. When the first connector 102 and the second connector 112 are mated, contact portions 104 of the first terminals 103 and recessed or concave portions 114 of the second terminals 113 come into mutual contact, whereby the first circuit board 101 and the second circuit board 111 are electrically connected.

However, in the conventional board-to-board connector pair, since the second connector 112 is formed, by means of over-molding, such that the plastic housing of second connector 112 covers portions of the second terminals 113, manufacturing costs are increased. Over-molding is often used because solder or flux may rise along the tail portions as indicated by arrow A, and contaminate the concave portions 114 if the second terminals 113 are press-fitted into the second connector 112. Further, since each first terminal 103 comes into contact with the corresponding second terminal 113 via a single contact portion, if the contact portion is contaminated, contact failure may occur.

Further, in order to increase the mating strength between the first connector 102 and the second connector 112, the concave portions 114 are formed on the second terminals 113, and distal end portions of the contact portions 104 of the first terminals 103 are received by the concave portions 114 for engagement therewith. This configuration may hinder the wiping effect of the contact portions 104. That is, when the first connector 102 and the second connector 112 are mated, the distal end surfaces of the contact portions 104 move while engaging surfaces of the second terminals 113, whereby dust or the like adhering the distal end surfaces of the contact portions 104 and the surfaces of the second terminals 113 is removed by the wiping operation. However, the wiping operation may be interrupted when the distal ends of the contact portions 104 enter the concave portions 114, thereby impairing the wiping effect.

SUMMARY OF THE INVENTION

An object of the present invention is to solve the above-mentioned problems in the conventional board-to-board connector pair and to provide a board-to-board connector pair which ensures reliable mating of first and second connectors, prevents occurrence of contact failure, lowers production cost, and has excellent reliability.

An electrical connector for interconnecting with a mating electrical connector comprises a generally rectangular dielectric housing with a mating face configured for engaging the mating electrical connector and a mounting face configured to be mounted adjacent a circuit member. A plurality of terminal support posts extend in a direction from the mounting face towards the mating face and each support post has oppositely facing first and second sidewalls and a connecting surface extending between the first and second sidewalls. The sidewalls are generally perpendicular to the mating face and the connecting surface is generally parallel to the mating face. A plurality of terminal receiving cavities are spaced along a longitudinal axis of the housing for receiving terminals therein. A plurality of terminals are provided with each including a solder tail portion and a generally U-shaped contact portion. The solder tail portion is positioned along the mounting face and the contact portion includes a first, distal contact leg, a second, proximal contact leg spaced from and generally parallel to the first contact leg and a connecting portion extending between the first and second contact legs. The first contact leg extends along the first sidewall, the second contact leg extending along the second sidewall, and the connecting portion extending along the connecting surface. Outer surfaces of the first and second contact legs are configured to operatively engage mating contact portions of the mating electrical connector.

The electrical connector may also include a plurality of openings in the mounting face, with each terminal having a distal end adjacent the first, distal contact leg, and each terminal distal end being received in one of the openings.

Each terminal may include first and second continuous surfaces, with the first continuous surface extending from the solder tail portion along the mating face and an inner surface of said U-shaped contact portion. The second continuous surface may extend along the outer surface of the first and second contact legs in order to reduce the likelihood of solder wicking from the solder tail to the outer surfaces of the first and second contact legs. In such embodiment, the first continuous surface extends along and engages an outer surface of said support post.

If desired, each of the first contact legs may include a solder barrier on the outer surface thereof. The electrical connector may further include two rows of generally parallel support posts with terminals mounted thereon. The two rows of support posts generally defining a central cavity therebetween for receiving a portion of a mating electrical connector therein.

Each solder tail portion may extends directly from the second contact leg at an angle thereto. In one embodiment, the angle would be 90 degrees. The U-shaped contact portion may substantially envelope the sidewalls and connecting surface of the support post in order to provide rigidity to the U-shaped contact portion.

Through such structure, it becomes possible to ensure reliable mating of the first and second connectors, prevent occurrence of contact failure, lower production cost, and improve reliability.

DESCRIPTION OF THE PREFERRED EMBODIMENT

An embodiment of the present invention will next be described in detail with reference to the drawings.

Figure 1:
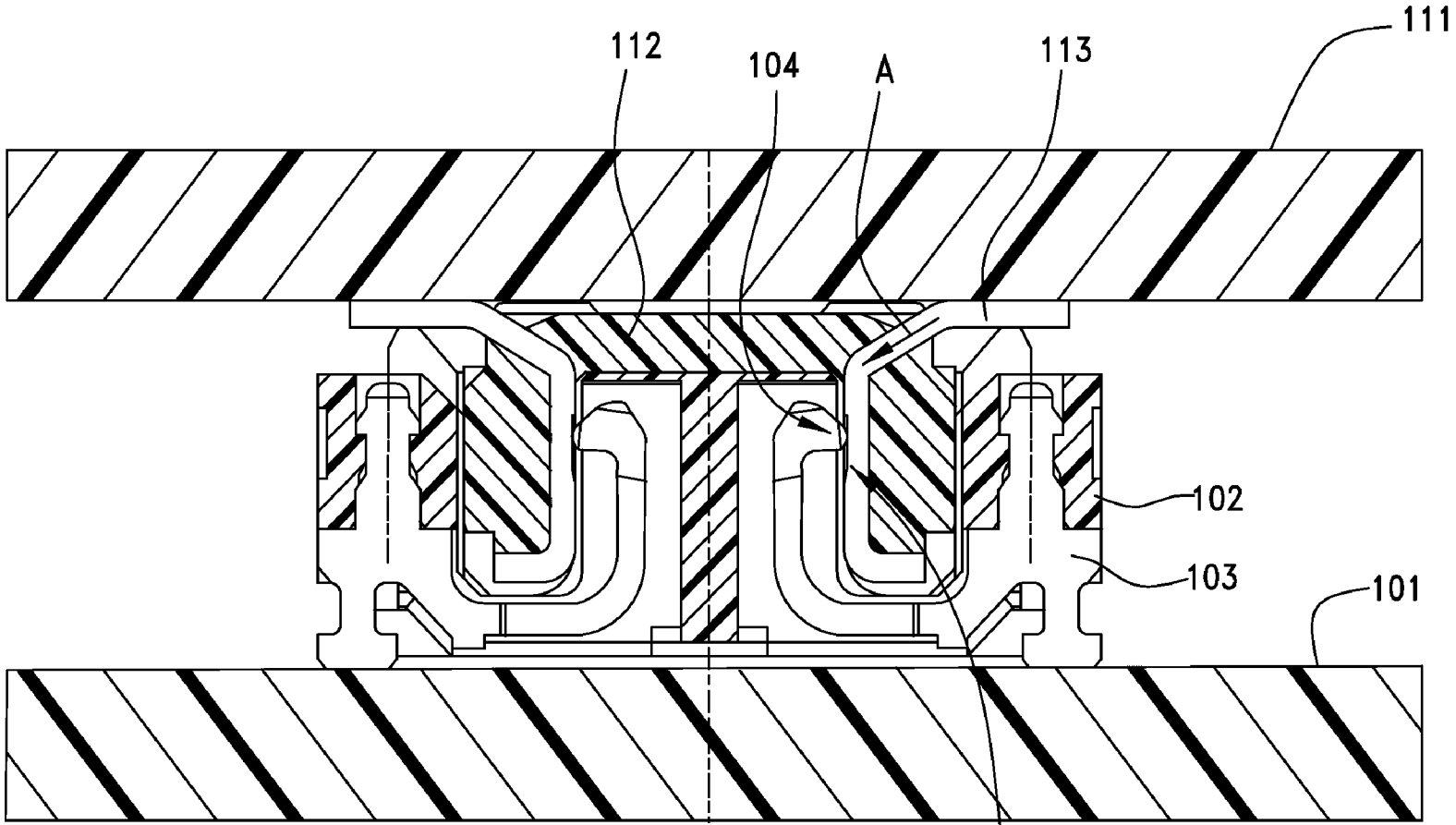
(Prior art) FIG.1
FIG. 1 is a sectional view of a conventional board-to-board connector pair.
Figure 2:
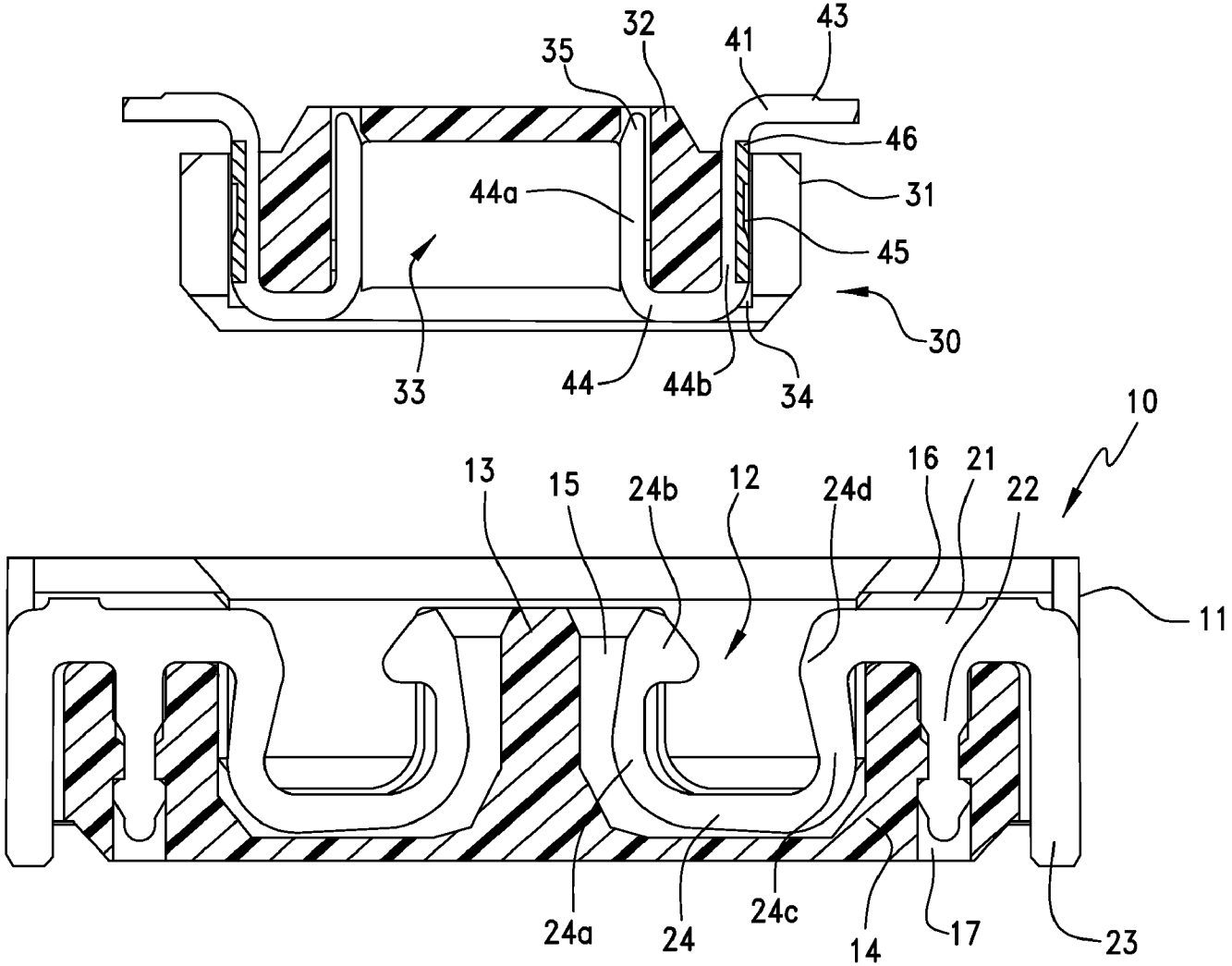
FIG. 2 is a sectional view of first and second connectors according to an embodiment of the present invention, taken along line B-B of FIG. 3.

Referring to FIG. 2, a first connector 10, which is one of paired board-to-board connectors according to the present embodiment and which is a surface-mount-type connector to be mounted on the surface of one board, is shown with its mating, second electrical connector 30, which is the other of the paired board-to-board connectors according to the present embodiment and which is also a surface-mount-type connector to be mounted on the surface of another board. The paired board-to-board connectors (i.e., a board-to-board connector pair) according to the present embodiment include the first connector 10 and the second connector 30 and electrically connect a pair of boards. Although the boards shown in FIG. 1 are printed circuit boards (PCBs), the boards can be of any type such as flexible printed circuits (FPC).

In the present embodiment, terms for expressing direction, such as up, down, left, right, front, and rear, are used for explaining the structure and action of respective portions of the board-to-board connectors; however, these terms represent respective directions for the case where the board-to-board connectors are used in an orientation shown in the drawings, and must be construed to represent corresponding different directions when the orientation of the board-to-board connectors is changed.

Figure 3:
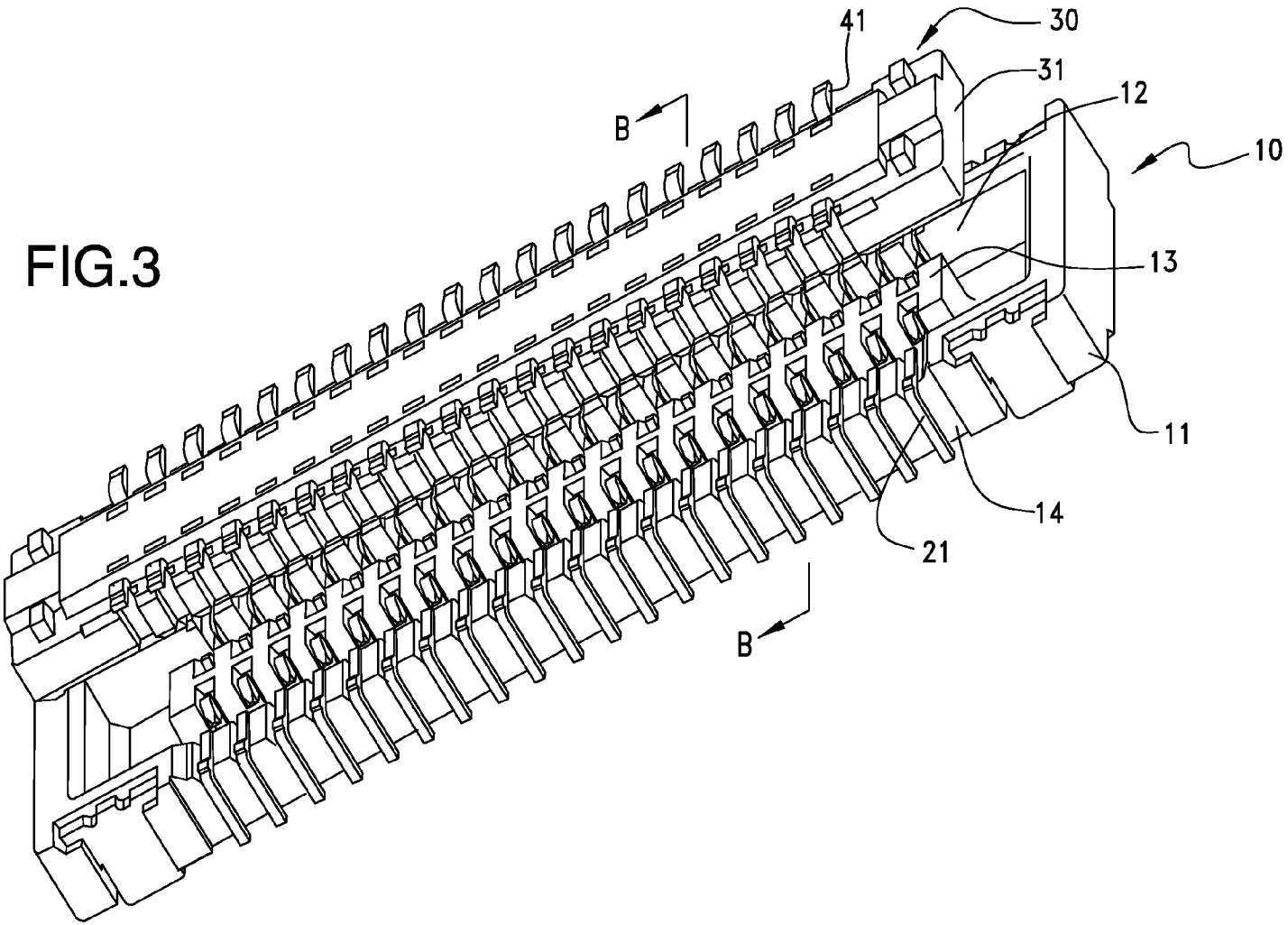
FIG. 3 is a perspective view of the first and second connectors according to the embodiment of the present invention.

The first connector 10 includes a first housing (connector main body) 11 integrally formed from an insulative material such as a synthetic resin or plastic. As shown in FIG. 3, the first housing 11 has a shape of a generally rectangular thick plate, and a generally rectangular concave portion or receptacle is formed on an upper surface of the first housing 11. In one embodiment, the first connector 10 has a size of about 15 mm (length) by about 4 mm (width) by about 1.3 mm (thickness); however, the size can be changed freely. In the concave portion, a ridge portion or central projection 13 is formed integrally with the first housing 11. Further, side wall portions 14 extending parallel to the ridge portion 13 are formed integrally with the first housing 11 such that the side wall portions 14 are located on the opposite sides of the ridge portion 13. In this case, the ridge portion 13 and the side wall portions 14 project upward from the bottom or mounting surface of the concave portion and extend along the longitudinal direction of the first housing 11. Thus, elongated groove portions 12 extending along the longitudinal direction of the first housing 11 are formed on both sides of the ridge portion 13 to be located between the ridge portion 13 and the corresponding side wall portion 14. In the illustrated example, only one ridge portion 13 is provided; however, a plurality of ridge portions may be provided, and the number of the ridge portions is arbitrary. Although the ridge portion 13 has a width of about 0.8 mm, the width may be changed freely.

First-terminal accommodation or receiving cavities or grooves 15 for accommodating first terminals 21 are formed such that they extend along the opposite side walls of the ridge portion 13 and the bottom walls surfaces of the groove portions 12. In the embodiment shown, twenty first-terminal accommodation cavities 15 are formed on each of the side walls of the ridge portion 13 and on the bottom wall surface of the corresponding groove portion 12 at a pitch of about 1 mm. Thus, twenty first terminals 21, which are accommodated within the twenty first-terminal accommodation cavities 15, are disposed on each of the side walls of the ridge portion 13 and the bottom wall surface of the corresponding groove portion 12 at a pitch of about 1 mm. Further, first-terminal accommodation grooves or recesses 16 are formed on the upper surfaces of the side wall portions 14 at positions corresponding to those of the first-terminal accommodation cavities 15. The first-terminal accommodation grooves 16 are identical in pitch and number with the first-terminal accommodation cavities 15. At the middle of each first-terminal accommodation groove 16, a first-terminal fixation or retention hole 17 is formed such that it vertically penetrates the corresponding side wall portion 14. Notably, the pitches and numbers of the first-terminal accommodation cavities 15, the first-terminal accommodation grooves 16, and the first terminals 21 can be changed freely.

As shown in FIG. 2, each of the first terminals 21 has a fixing or retention portion or leg 22, a solder tail portion 23, and a first connection or contact portion 24, and is integrally formed from an electrically conductive metal sheet through punching or blanking. In the embodiment shown, terminals 21 are not significantly formed after the punching or blanking process and therefore remain in the plane of the sheet metal from which they were punched. Each of the first terminals 21 assumes a side shape obtained by combining the shape of the letter U and that of the letter F, wherein the first connection portion 24 is formed into a generally U-like shape, and the remaining portion is formed into a generally F-like shape.

The first connection portion 24 has a front side wall portion 24*a* (a side wall portion located near the distal end), which is accommodated in the first-terminal accommodation cavity 15 formed on the corresponding side wall of the ridge portion 13, and a rear side wall portion 24*c* (a side wall portion located near the solder tail portion), which extends in the vertical direction. A bottom portion between the front side wall portion 24*a* and the rear side wall portion 24*c*; i.e., a portion corresponding to the horizontal portion of the letter U, extends in the lateral direction and is accommodated in the first-terminal accommodation cavity 15 formed on the bottom surface of the corresponding groove portion 12. A first projecting or contact portion 24*b* is formed in the vicinity of the upper end of the front side wall portion 24*a*, and a second projecting or contact portion 24*d* is formed in the vicinity of the upper end of the rear side wall portion 24*c*. The first and second projecting portions 24*b* and 24*d* project such that they face each other. The first projecting portion 24*b* projects from the first-terminal accommodation cavity 15 and is located within the groove portion 12. An upper half of the rear side wall portion 24*c* including the second projecting portion 24*d* projects from the first-terminal accommodation cavity 15 and is located within the groove portion 12.

The first connection portion 24 has a spring property primarily due to elastic deformation of the front side wall portion 24*a* and the bottom portion 24*c*. Therefore, when the first connector 10 is mated with the second connector 30 and the first projecting portion 24*b* is thus pushed toward the ridge portion 13 by a front side wall portion 44*a* of a second terminal 41 (described below), the first connection portion 24 reacts by virtue of its spring property, so that the first projecting portion 24*b* and the second projecting portion 24*d* nip or engage the second terminal 24. Thus, the reliability of the electrical connection between first terminal 21 and second terminal 41 can be extremely high.

Further, the upper horizontal portion of the first terminal 21 extends in the lateral direction and is accommodated within the corresponding first-terminal accommodation groove 16. The second projecting portion 24*d* is connected to an inner end (end located on the side toward the ridge portion 13) of the upper horizontal portion, and the upper end of the solder tail portion 23 is connected to an outer end (end located on the side opposite the ridge portion 13) of the upper horizontal portion. The solder tail portion 23 extends in the vertical direction downward, and the lower end surface of the solder tail portion 23 is soldered to a wiring land or pad (not shown) formed on the surface of a circuit board or member. In this case, a path along the first terminal 21 extending from the lower end surface of the solder tail portion 23 to the second projecting portion 24*d* of the first terminal 21 is long and generally travels in a complex manner. Therefore, the phenomenon of solder rising or wicking from solder tail portion 23 all of the way to second projecting portion 24*d* (as well as first projecting portion 24*b*) is less likely to occur. That is, there is little likelihood that solder ascends along the above-mentioned path and adheres to the second projecting portion 24*d*, let alone the possibility that solder adheres to the first projecting portion 24*b* which is separated further from the solder tail portion 23 as compared with the second projecting portion 24*d*.

Moreover, if necessary, a solder barrier (not shown) may be formed in the middle of the path extending from the solder tail portion 23 to the first projecting portion 24*b*. An example of the solder barrier portion is a nickel (Ni) coating layer formed through plating. However, a coating layer of any type may be used, so long as solder substantially does not adhere to the coating layer, and no limitation is imposed on the method of forming the coating layer.

The upper end of the fixing portion 22 is connected to the middle of the upper horizontal portion. The fixing portion 22 extends in the vertical direction, and is accommodated within a first-terminal fixing hole 17 formed in the side wall portion 14. As shown in FIG. 1, concave portions or recesses are formed on the opposite side surfaces of the fixing portion 22, and projections corresponding to the concave portions are formed on the wall surface of the first-terminal fixing hole 17. When the fixing portion 22 is press-fitted into the first-terminal fixing hole 17 from above, as shown in FIG. 1, the projections of the first-terminal fixing hole 17 enter the concave portions of the fixing portion 22, so that the fixing portion 22 and the first-terminal fixing hole 17 are in a mated condition, and the fixing portion 22 is prevented from sliding out of the first-terminal fixing hole 17. Thus, the first terminal 21 is fixed to the first connector 10.

In order to improve adhesion of solder, a gold (Au) coating layer is preferably formed on the lower end surface of the solder tail portion 23 through plating. Further, in order to reduce electrical contact resistance, a gold coating layer is preferably formed on at least the front surface of the first projecting portion 24*b* through plating.

The second connector 30 includes a second housing (connector main body) 31 integrally formed from an insulative material such as a synthetic resin or plastic. As shown in FIG. 3, the second housing 31 has a shape of a generally rectangular thick plate. In one embodiment, the second housing 31 has a size of about 14 mm (length) by about 3 mm (width) by about 1.1 mm (thickness); however, the size can be changed freely. On the lower surface of the second housing 31 (as oriented in FIG. 3), two ridge or rail portions 32 extending in the longitudinal direction are formed integrally with the second housing 31. The ridge portions 32 are formed along the opposite lateral sides of the second housing 31. Further, an elongated groove portion 33 extending in the longitudinal direction of the second housing 31 is formed between the two ridge portions 32. Notably, in the illustrated example, the number of the ridge portions 32 is two; however, a single ridge portion or three or more ridge portions may be provided, and the number of the ridge portions is arbitrary. Although each of the ridge portions 33 has a width of about 0.8 mm, the width may be changed freely. When viewed in cross-section, the ridge portions appear to be a post projecting from the base of housing 31.

Second-terminal accommodation or receiving cavities (grooves) 34 for accommodating second terminals 41 are formed such that they extend along the opposite side walls of each ridge portion 32 and the lower surface thereof. In the embodiment shown, twenty second-terminal accommodation cavities 34 are formed on the opposite side walls and the lower surface of each ridge portion 32 at a pitch of about 1 mm. Thus, twenty second terminals 41, which are accommodated within the twenty second-terminal accommodation cavities 34, are disposed on the opposite side walls and the lower surface of each ridge portion 32 at a pitch of about 1 mm. Moreover, second-terminal end accommodation or receiving holes 35 are formed at the corners of the groove portion 33 at longitudinal positions corresponding to those of the second-terminal accommodation cavities 34. The second-terminal end accommodation holes 35 are identical in pitch and number with the second-terminal accommodation cavities 34. Notably, the pitches and numbers of the second-terminal accommodation cavities 34, the second-terminal end accommodation holes 35, and the second terminals 41 can be changed freely.

As shown in FIG. 2, each of the second terminals 41 has a solder tail portion 43 and a second connection or contact portion 44, and is integrally formed from an electrically conductive metal sheet through punching. Each of the second terminals 41 assumes a side shape obtained by combining the letter U and the letter I, wherein the second connection portion 44 is formed into a generally U-like shape, and the solder tail portion 43 is formed into a generally I-like shape.

The second connection portion 44 has a vertically extending front side wall portion or contact leg 44*a* (a side wall portion located near the distal end), which is accommodated in the second-terminal accommodation cavity 34 formed on the inner side wall of the ridge portion 32, and a vertically extending rear side wall portion or contact leg 44*b* (a side wall portion located near the solder tail), which is accommodated in the second-terminal accommodation cavity 34 formed on the outer side wall of the ridge portion 32. A bottom connecting portion or bight between the front side wall portion 44*a* and the rear side wall portion 44*b*; i.e., a portion corresponding to the horizontal portion of the letter U, extends in the lateral direction and is accommodated in the second-terminal accommodation cavity 34 formed on the lower surface of the ridge portion 32. The end portion of the front side wall portion 44*a* is received in the second-terminal end accommodation hole 35. The second terminal 41 is fixed to the second connector 30 through press-fitting of the second connection portion 44 into the second-terminal accommodation cavity 34.

The inner end (end on the side toward the groove portion 33) of the solder tail portion 43 is connected to the rear side wall portion 44*b*, and extends in the lateral direction. The upper surface of the solder tail portion 43 is soldered to a wiring land or pad (not shown) formed on the surface of a circuit board or member.

An engagement recess (engagement portion) 45 is formed on an outer side surface of the rear side wall portion 44*b* of the second connection portion 44 such that the engagement recess portion 45 engages the second projecting portion 24*d* of the corresponding first terminal 21 when first and second connectors 10 and 30 are mated. When the first connector 10 is mated with the second connector 30, since the second projecting portion 24*d* enters and engages with the engagement recess portion 45, the connection between the first terminal 21 and the second terminal 41 is reliably maintained, whereby the likelihood of disengagement of the first connector 10 and the second connector 30 is reduced. Notably, the first projecting portion 24*b* of the first terminal 21 comes into contact with the flat surface of the front side wall portion 44*a* of the second connection portion 44.

A solder barrier (barrier portion) 46 formed from a coating layer to which solder substantially does not adhere is provided so as to cover a portion of the rear side wall portion 44*b* of the second connection portion 44. An example of the solder barrier 46 is a nickel (Ni) coating layer formed through plating. However, a coating layer of any type may be used, so long as solder substantially does not adhere to the coating layer, and no limitation is imposed on the method of forming the coating layer. The solder barrier 46 prevents occurrence of the phenomenon in which solder ascends along the second terminal 41 and adheres to the surface of the rear side wall portion 44*b* when the solder tail portion 43 is soldered to a wiring land of a board. Notably, the solder barrier 46 is desirably formed in an area including at least the engagement recess portion 45. Thus, solder having ascended from the solder tail portion 43 is prevented from adhering and filling the engagement recess portion 45. Notably, no solder adheres to the front side wall portion 44*a* due to rising of the solder, because the front side wall portion 44*a* is separated further from the solder tail portion 43 as compared with the rear side wall portion 44*b*, the path along the second terminal 41 is bent, and the solder barrier 46 is present in the middle of the path.

In order to improve adhesion of solder, a gold coating layer is preferably formed on the upper surface of the solder tail 43 through plating. Further, in order to lower electrical contact resistance, a gold coating layer is preferably formed on at least the front surface of the front side wall portion 44*a* through plating.

In operation, first connector 10 would be surface-mounted onto a circuit member or board (not shown) by means of soldering the solder tail portions 23 of the first terminals 21 to corresponding wiring lands or pads of the board. Similarly, the second connector 30 would be surface-mounted onto a second board (not shown) by means of soldering the solder tail portions 43 of the second terminals 41 to corresponding wiring lands or pads of the second board.

Prior to mating, as shown in FIG. 2, the first connector 10 and the second connector 30 are positioned such that the upper surface of the first connector 10 and the lower surface of the second connector 30 face each other. In this state, the upper surface of the first connector 10 and the lower surface of the second connector 30 are generally parallel to each other, and the boards carrying the first connector 10 and the second connector 30, respectively, are also generally parallel to each other.

Figure 4:
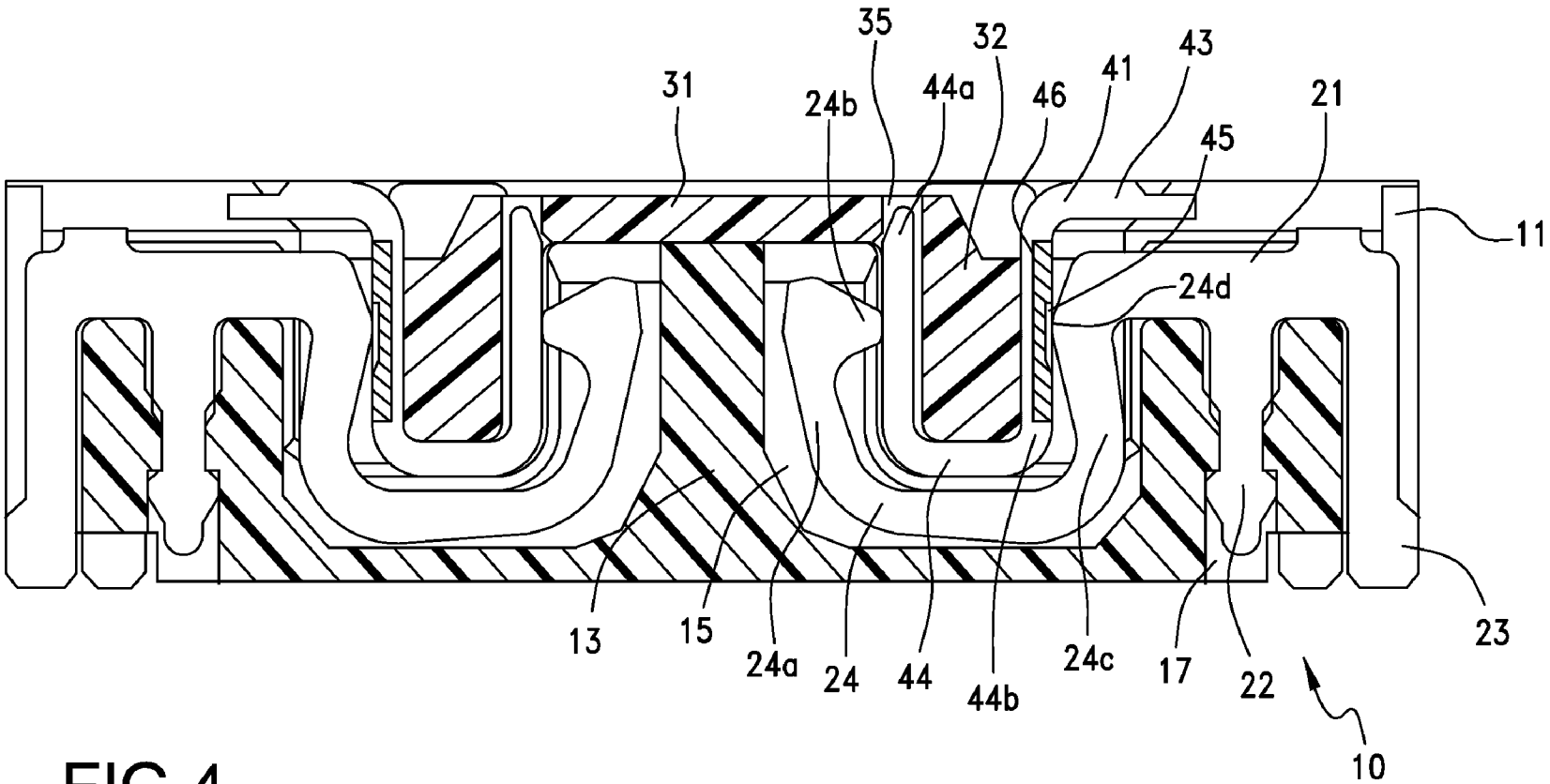
FIG. 4 is a sectional view showing the first and second connectors mated together according to the embodiment of the present invention.
Figure 5:
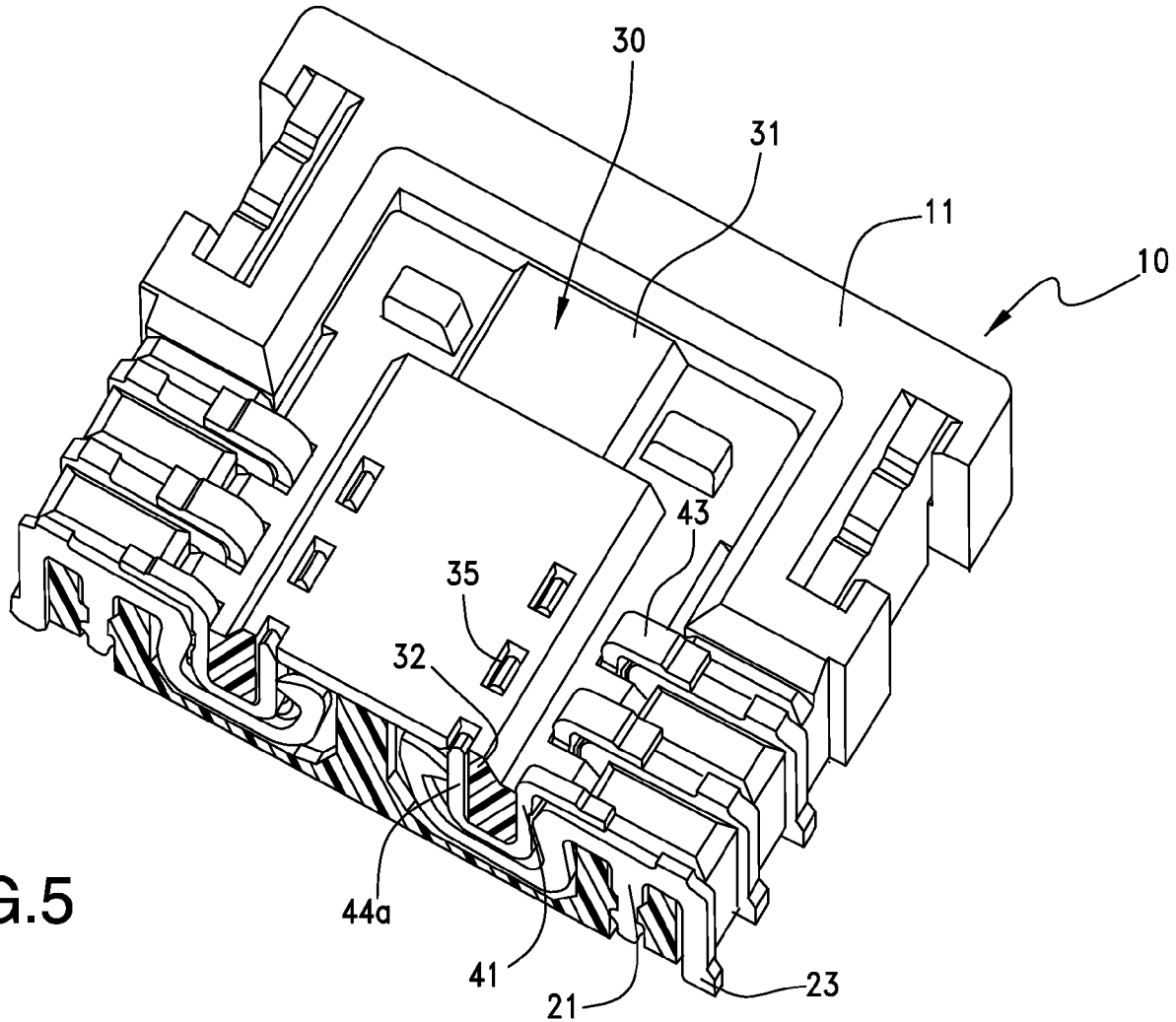
FIG. 5 is a fragmented perspective view showing the first and second connectors mated together according to the embodiment of the present invention.

Subsequently, the first connector 10 and the second connector 30 are moved toward each other, or one of the first connector 10 and the second connector 30 is moved toward the other connector, whereby they are mated with each other as shown in FIGS. 4 and 5. Notably, in FIGS. 4 and 5, boards are omitted in order to simplify the illustration. In the state in which the first connector 10 and the second connector 30 are mated with each other, the ridge portion 13 of the first connector 10 is inserted into the groove portion 33 of the second connector 30, and the ridge portions 32 of the second connector 30 are inserted into the corresponding groove portions 12 of the first connector 10. As a result, the first projecting portion 24*b* of the first connection portion 24 of each first terminal 21 comes into contact with the flat front surface of the front side wall portion 44*a* of the second connection portion 44 of the corresponding second terminal 41. Further, the second projecting portion 24*d* of the first connection portion 24 of each first terminal 21 engages the engagement recess portion 45 of the rear side wall portion 44*b* of the second connection portion 44 of the corresponding second terminal 41. That is, each first terminal 21 and the corresponding second terminal 41 electrically communicate with each other via a first contact point (main contact portion) at which the first projecting portion 24*b* comes into contact with the front side wall portion 44*a*, and a second contact portion (sub contact portion) at which the second projecting portion 24*d* comes into contact with the rear side wall portion 44*b*.

In the present embodiment, the distance between the facing surfaces of the first and second projecting portions 24*b* and 24*d* of the first connection portion 24 of each first terminal 21 is shorter than the distance between the outer surfaces (surfaces opposite the ridge portion 32) of the front side wall portion 44*a* and the rear side wall portion 44*b* of the second connection portion 44 of each second terminal 41. The first connection portion 24 has a spring property. Therefore, when, as a result of mating of the first connector 10 and the second connector 30, the ridge portions 32 of the second connector 30 are inserted into the corresponding groove portions 12 of the first connector 10 and the second connection portion 44 of each second terminal 41 is inserted into the first connecting portion 24 of the corresponding first terminal 21, the distance between the facing surfaces of the first and second projecting portions 24*b* and 24*d* of the first connection portion 24 of the first terminal 21 increases, and mainly the front side wall portion 24*a* and the bottom portion elastically deform, whereby the first projecting portion 24*b* is pushed by the front side wall portion 44*a* of the second terminal 41 and moves toward the ridge portion 13. In this case, by virtue of its spring property, the first connection portion 24 reacts to restore its original shape. Therefore, the second terminal 41 is nipped or engaged by the first projecting portion 24*b* of the front side wall portion 24*a* and the second projecting portion 24*d* of the rear side wall portion 24*c*.

As a result, the end of the first projecting portion 24*b* of each first terminal 21 is pressed against the front surface of the front side wall portion 44*a* of the corresponding second terminal 41. Thus, reliable contact is established between the first projecting portion 24*b* and the front side wall portion 44*a*, and electrical continuity at the first contact portion is secured. Further, the end of the second projecting portion 24*d* of each first terminal 21 is forced to enter the engagement recess portion 45 of the corresponding second terminal 41. Thus, reliable contact is established between the second projecting portion 24*d* and the engagement recess portion 45, and electrical continuity at the second contact portion is secured. Further, reliable engagement is realized between the second projecting portion 24*d* and the engagement recess portion 45, and the second connection portion 44 of each second terminal 41 is prevented from coming off the first connection portion 24 of the corresponding first terminal 21, whereby the first connector 10 and the second connector 30 are mated with each other in a reliable manner.

Further, when the second connection portion 44 of each second terminal 41 is inserted into the first connection portion 24 of the corresponding first terminal 21, the tip portion of the first projecting portion 24*b* of the first terminal 21 moves while scrubbing or wiping the flat surface of the front side wall portion 44*a* in a state in which the tip portion is pushed against the front surface of the front side wall portion 44*a* of the second terminal 21. Therefore, a scraping effect or wiping effect is produced, so that substances which hinder electrical continuity, such as dust, dirt or film adhering to the tip end of the first projection portion 24*b* and the front surface of the front side all portion 44*a*, are removed by means of wiping. Therefore, reliable electrical continuity is secured at the first contact portion.

As described above, in the present embodiment, the first terminals 21 each having the generally U-shaped first connection portion 24 are attached to the first connector 10, and the second terminals 41 each having the generally U-shaped second connection portion 44 to be fitted into the first connection portion 24 of the corresponding first terminal 21 are attached to the second connector 30. When the first connector 10 and the second connector 30 are mated with each other, the first projecting portion 24*b* of the first terminal 21 comes into contact with the front side wall portion 44*a* of the second terminal 41 so that a first contact portion (main contact portion) is formed, and the second projecting portion 24*d* of the first terminal 21 engages with the engagement recess portion 45 of the rear side wall portion 44*b* of the second terminal 41 so that a second contact portion (sub contact portion) is formed.

Therefore, it is possible to provide a board-to-board connector pair in which the first connector 10 and the second connector 30 are mated with each other with high reliability and performance which results in an electrical connector having lower production cost and excellent reliability.

More specifically, each first terminal 21 assumes a side shape obtained by combining the shape of the letter U and that of the letter F, and the path extending along the first terminal 21 from the solder tail portion 23 to the first projecting portion 24*b* is long and travels in a relatively complicated pattern. Therefore, solder substantially does not adhere to the first projecting portion 24*b*, which adherence would otherwise occur because of the phenomenon of solder rising. Further, since the distance of the path is long, a solder barrier portion can be provided at the middle of the path so as to prevent adherence of solder to the first projecting portion 24*b* without fail.

Further, each second terminal 41 assumes a generally U-like side shape, and the path extending along the second terminal 41 from the solder tail portion 43 to the front side wall portion 44*a* is long and is extends in a generally complicated pattern. Therefore, solder substantially does not adhere to the front side wall portion 44*a*, which adherence would otherwise occur because of solder rising. Further, since the distance of the path is long, the solder barrier 46 can be provided at the middle of the path so as to prevent adherence of solder to the front side wall portion 44*a* without fail. Accordingly, the second housing 31 is not required to be over-molded, such that the second housing 31 covers a portion of each second terminal 41, and the second terminals 41 can be attached to the second housing 31 through press-fitting the second terminals 41 into the second housing 31. Thus, production costs of the second connector 30 can be reduced.

Moreover, since, as described above, rising of solder does not cause adhesion of solder to the first contact portion (main contact portion) at which the first projecting portion 24*b* and the front side wall portion 44*a* come into contact with each other, electrical continuity is not hindered by solder. Therefore, reliable electrical continuity can be established between the first terminals 21 and the second terminals 41.

Further, the greater portion of the U-shaped second connection portion 44 of each second terminal 41 is press-fitted into the corresponding second-terminal accommodation cavity 34 formed on the outer periphery of the ridge portion 32 of the second housing 31. In other words, the U-shaped second connection portion 44 is supported by ridge portion 32. Therefore, the second connection portion 44 is protected in that it is less likely to deform upon receipt of unexpected external force. Further, the distal end portion of the front side wall portion 44*a* of the second connection portion 44 is received within the second-terminal end accommodation hole 35. Therefore, the distal end portion does not move apart from the wall surface of the ridge portion 32 and is retained therein for further stability.

The first projecting portion 24*b* of each first terminal 21 comes into contact with the front side wall portion 44*a* of the corresponding second terminal 41, whereby the first contact portion serving as the main contact portion is formed, and the second projecting portion 24*d* of each first terminal 21 engages the engagement recess portion 45 of the rear side wall portion 44*b* of the corresponding second terminal 41, whereby the second contact portion serving as the sub contact portion is formed. Since electrical continuity is established between the first terminal 21 and the second terminal 41 at two contact portions, conduction failure does not occur, and reliability is improved. Further, since no recess is formed on the front side wall portion 44*a* of each second terminal 41, the wiping operation of the first projecting portion 24*b* is not interrupted. Thus, a sufficient wiping effect is attained, and reliable electrical continuity can be established at the first contact portion serving as the main contact portion.

Moreover, since the solder barrier 46 is formed in an area including at least the engagement recess portion 45, solder having ascended from the solder tail portion 43 does not fill the engagement recess portion 45. Therefore, the end of the second projecting portion 24*d* of each first terminal 21 is forced to enter the engagement recess portion 45 of the corresponding second terminal 41. Thus, reliable engagement is more likely to be established between the second projecting portion 24*d* and the engagement recess portion 45, and the second connection portion 44 of each second terminal 41 is less likely to come off the first connection portion 24 of the corresponding first terminal 21. As a result, the first connector 10 and the second connector 30 are mated with each other in a reliable manner. Further, electrical continuity is secured at the second contact portion serving as the sub contact portion.

In the present embodiment, from the viewpoint of wiping, the front side wall portion 44*a* of the second connection portion 44 is configured such that its contact portion for contact with the first projecting portion 24*b* of the first connection portion 24 is a flat surface. However, from the viewpoint of locking strength, a concave portion may be formed at the contact portion. Further, the entirety of the front side wall portion 44*a* may be formed such that its central portion projects frontward for engagement with the first projecting portion 24*b*.

In the present embodiment, the contact portion of the rear side wall portion 44*b* of the second connection portion 44 comprises the engagement recess portion 45 for engagement with the second projecting portion 24*d*. However, the contact portion may be configured to be flat without formation of the engagement recess portion 45 and to merely come into contact with the second projecting portion 24*d*.

The present invention is not limited to the above-described embodiments. Numerous modifications and variations of the present invention are possible in light of the spirit of the present invention, and they are not excluded from the scope of the present invention.

What is claimed is:

1. An electrical connector for connecting to a mating electrical connector, comprising:

a generally rectangular dielectric housing, the rectangular dielectric housing including:

a mating face configured for engaging the mating electrical connector, a mounting face configured to be mounted adjacent a circuit member, a plurality of terminal support posts extending in a direction from the mounting face towards the mating face, each support post having oppositely facing first and second sidewalls and a connecting surface extending therebetween, the sidewalls being generally perpendicular to the mating face and the connecting surface being generally parallel to the mating face, and a plurality of terminal receiving cavities spaced along a longitudinal axis of the rectangular dielectric housing for, each terminal receiving cavity including an opening extending from each terminal receiving cavity to the mounting face; and a plurality of terminals, each terminal including a solder tail portion and a generally U-shaped contact portion, the solder tail portion being positioned along the mounting face, the U-shaped contact portion including a first distal contact leg, a second proximal contact leg spaced from and generally parallel to the first contact leg, and a connecting portion extending therebetween;

wherein:

the first contact leg extends along the first sidewall and includes a distal end being received in one of the openings adjacent the mounting face, the second contact leg extends along the second sidewall, and the connecting portion extends along the connecting surface, each contact leg including an outer surface, each outer surface being configured to operatively engage mating contact portions of the mating electrical connector; and each second proximal contact leg includes a solder barrier disposed on the outer surface thereof.

2. The electrical connector of claim 1, wherein each terminal includes first and second continuous surfaces, the first continuous surface extending from the solder tail portion along the mating face and an inner surface of the U-shaped contact portion, and the second continuous surface extending along the outer surface of the contact legs in order to reduce the likelihood of solder wicking from the solder tail portion to the outer surfaces of the contact legs.

3. The electrical connector of claim 2, wherein each first continuous surface extends along and engages an outer surface of one of the support posts.

4. The electrical connector of claim 3, wherein each the first contact leg includes a solder barrier on the outer surface thereof.

5. The electrical connector of claim 1, further including two rows of generally parallel terminal support posts with terminals mounted thereon, the two rows of terminal support posts generally defining a central cavity therebetween for receiving a portion of the mating electrical connector therein.

6. The electrical connector of claim 1, wherein the solder tail portion extends directly from the second contact leg at an angle thereto.

7. The electrical connector of claim 6, wherein the solder tail portion is generally perpendicular to the second contact leg.

8. The electrical connector of claim 1, wherein the U-shaped contact portion substantially envelopes the sidewalls and connecting surface of each terminal support post in order to provide rigidity to the U-shaped contact portion.

9. A board-to-board connector for connecting with a mating electrical connector, comprising:

a low profile, generally rectangular dielectric housing, the housing including:

a mating face configured for engaging the mating electrical connector, a mounting face configured for mounting adjacent a circuit member, and a rail extending in a direction from the mounting face towards the mating face, the rail having first and second oppositely facing sides, a plurality of spaced apart terminal receiving cavities extending along the rail, and further including an opening extending from each terminal receiving cavity to the mounting face; and a plurality of terminals, each being positioned within one of the terminal receiving cavities, and including a solder tail portion positioned along the mounting face and a generally U-shaped body portion extending around the rail, the U-shaped body portion having a first distal contact leg positioned along the first side of the rail, a second proximal contact leg positioned along the second side of the rail and a bight portion connecting the contact legs and extending generally parallel to the mating face, outer surfaces of the contact legs being configured to operatively engage mating contact portions of the mating electrical connector and a distal end of each first contact leg being received in one of the openings adjacent the mounting face;

wherein each second proximal contact leg includes a solder barrier disposed on the outer surface thereof.

10. The electrical connector of claim 9 wherein the solder tail portion extends directly from the second contact leg and is generally perpendicular thereto and the contact legs are generally parallel to each other.

11. The electrical connector of claim 10 wherein each terminal includes first and second continuous surfaces, the first continuous surface extending from the solder tail portion along the mating face and an inner surface of the U-shaped body portion, and the second continuous surface extending along the outer surface of the contact legs in order to reduce the likelihood of solder wicking from the solder tail portion to the outer surfaces of the contact legs.

12. The electrical connector of claim 11, wherein each first continuous surface extends along and engages an outer surface of the rail.

13. The electrical connector of claim 9, wherein each first contact leg includes a solder barrier on the outer surface thereof.

14. The electrical connector of claim 9, further including two rows of generally parallel support posts with terminals mounted thereon, generally defining a central cavity therebetween for receiving a portion of the mating electrical connector therein.

15. The electrical connector of claim 10, further including two rows of generally parallel support posts with terminals mounted thereon, generally defining a central cavity therebetween for receiving a portion of the mating electrical connector therein.

* * * * *